US006102386A

United States Patent [19]

Shigetomi et al.

[11] Patent Number: 6,102,386

[45] Date of Patent: Aug. 15, 2000

[54] IMAGE FORMING APPARATUS

[75] Inventors: Masahiro Shigetomi; Yozo Fujii, both of Hachioji, Japan

[73] Assignee: Konica Corporation, Tokyo, Japan

[21] Appl. No.: 09/184,830

[22] Filed: Nov. 2, 1998

[30] Foreign Application Priority Data

Nov. 5, 1997 [JP] Japan ..... 9-302718

[51] Int. Cl.[7] ..... B65H 3/44

[52] U.S. Cl. ..... 271/9.11; 271/9.13; 271/162

[58] Field of Search ..... 271/9.11, 9.13, 271/9.01, 9.05, 162, 164

[56] References Cited

U.S. PATENT DOCUMENTS 4,966,356 10/1990 Ohyabu et al. ..... 271/9.11
5,485,990 1/1996 Kato ..... 271/9.11 X

FOREIGN PATENT DOCUMENTS 2534435 6/1966 Japan .
5-740 1/1993 Japan ..... 271/9.11
6-191665 7/1994 Japan ..... 271/9.11
2576439 11/1996 Japan .

*Primary Examiner*—David H. Bollinger
*Attorney, Agent, or Firm*—Frishauf, Holtz, Goodman, Langer & Chick, P.C.

[57] ABSTRACT

An image forming apparatus is provided which includes a first paper cassette provided in a lower portion of a main body of the image forming apparatus for housing recording papers therein and for feeding the recording papers to the main body through a first paper feeding path, and a second cassette provided below the first paper cassette for housing recording papers therein. At least a part housing the recording papers of the first paper cassette is capable of being pulled out in a pulling out direction which is in a feeding direction of the recording papers from the first cassette, and at least a part housing the recording papers of the second paper cassette is capable of being pulled out in the same pulling out direction of the first paper cassette. The image forming apparatus further includes a paper feeding section integrally provided on the second paper cassette and located on a front side of the first paper cassette in the pulling out direction of the first and second paper cassettes, for exclusively feeding the recording papers from the second paper cassette to the main body of the image forming apparatus through a second paper feeding path.

5 Claims, 6 Drawing Sheets

IMAGE FORMING APPARATUS

BACKGROUND OF THE INVENTION

The present invention relates to an image forming apparatus such as a printer. More particularly, the present invention relates to an image forming apparatus provided with paper cassettes housing plural papers one above the other in the lower portion of the apparatus main body.

Heretofore, a system in which vertically stacked cassettes which house plural papers in the lower portion of the apparatus main body are provided and papers are selectively fed from a prescribed paper cassette is known.

Aforesaid system will be explained referring to FIG. 6 showing the structural side view of a conventional image forming apparatus. In the image forming apparatus of FIG. 6, paper cassettes 101 and 102 are loaded on one end of apparatus main body 103. Papers fed from paper cassette 101 are supplied (fed) through paper feeding path 104. Papers fed from paper cassette 102 are supplied (fed) through paper feeding path 105. In both cases, papers are fed to transfer position 109, where toner images formed on photoreceptor drum 106 are transferred onto the papers by means of transfer device 107. After that, aforesaid paper passes along the arrowed route, and is subjected to toner image fixing by means of fixing device 108. Then, the paper is ejected, and the surface of photoreceptor drum 106 in which transfer is completed is electrically neutralized and cleaned.

The other prior art image forming apparatus has the following structure. Namely, on the lower portion of the apparatus main body of the image forming apparatus, paper cassettes housing plural papers are provided one above the other. When a paper sheet is fed from the lower paper cassette to the apparatus main body, the paper passes through a slit-shaped path inside the upper paper cassette, and is fed into the apparatus main body. The procedure after that is the same as the prior art as shown in FIG. 6. After the paper is subjected to toner image fixing, aforesaid paper is ejected (see Japanese Patent Registration No. 2534435 or 2576439).

However, the above-mentioned conventional systems have the following shortcomings. In the former image forming apparatus, plural paper cassettes are loaded on one end of the image forming apparatus. Therefore, these paper cassettes protrude from the apparatus main body, and considerable floor space is necessary. In addition, in the latter image forming apparatus, when a paper fed from the lower paper cassette is jammed in the slit-shaped path inside the upper paper cassette, there is a likelihood that the jammed paper may be torn if the upper or lower paper cassette is pulled out.

SUMMARY OF THE INVENTION

The present invention was achieved considering the above-mentioned problems. The objective of the present invention is to provide an image forming apparatus having plural paper cassettes, in which no noticeable installation space is necessary for the paper cassettes compared to the apparatus main body, detachment of the paper cassettes is easy and the removal of paper jamming is easy.

The above-mentioned objective is attained by the following means. Namely, an image forming apparatus provided with a first paper cassette housing paper sheets, located in the lower portion of the apparatus main body and capable of being pulled at least a portion housing aforesaid paper sheets out of a side of the above-mentioned apparatus main body and a second paper cassette housing paper sheets, located below the above-mentioned first cassette, and also capable of being pulled at least a portion housing papers out of said side of the above-mentioned apparatus main body in which a paper feeding section used exclusively for feeding papers housed in the second paper cassette to the above-mentioned apparatus main body is integrally provided on the second paper cassette and located at a leading edge in the feeding end of the above-mentioned first paper cassette.

Here, "side" includes all horizontal directions of the image forming apparatus.

DETAILED DESCRIPTION OF THE PREFERRED EMBODIMENT

Figure 1:
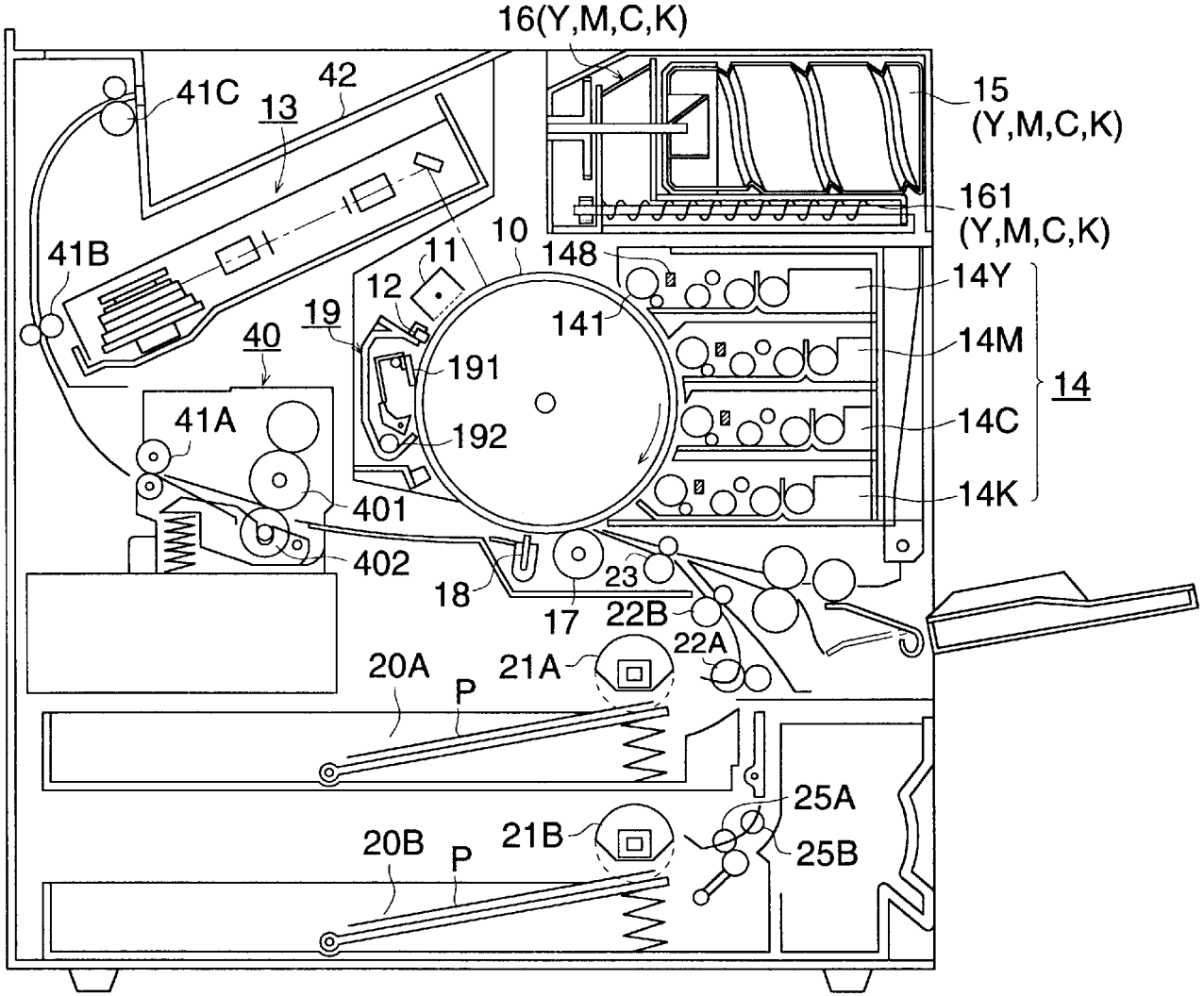
FIG. 1 is a side view showing a constitution of an image forming apparatus of a preferred embodiment of the present invention.
Figure 2:
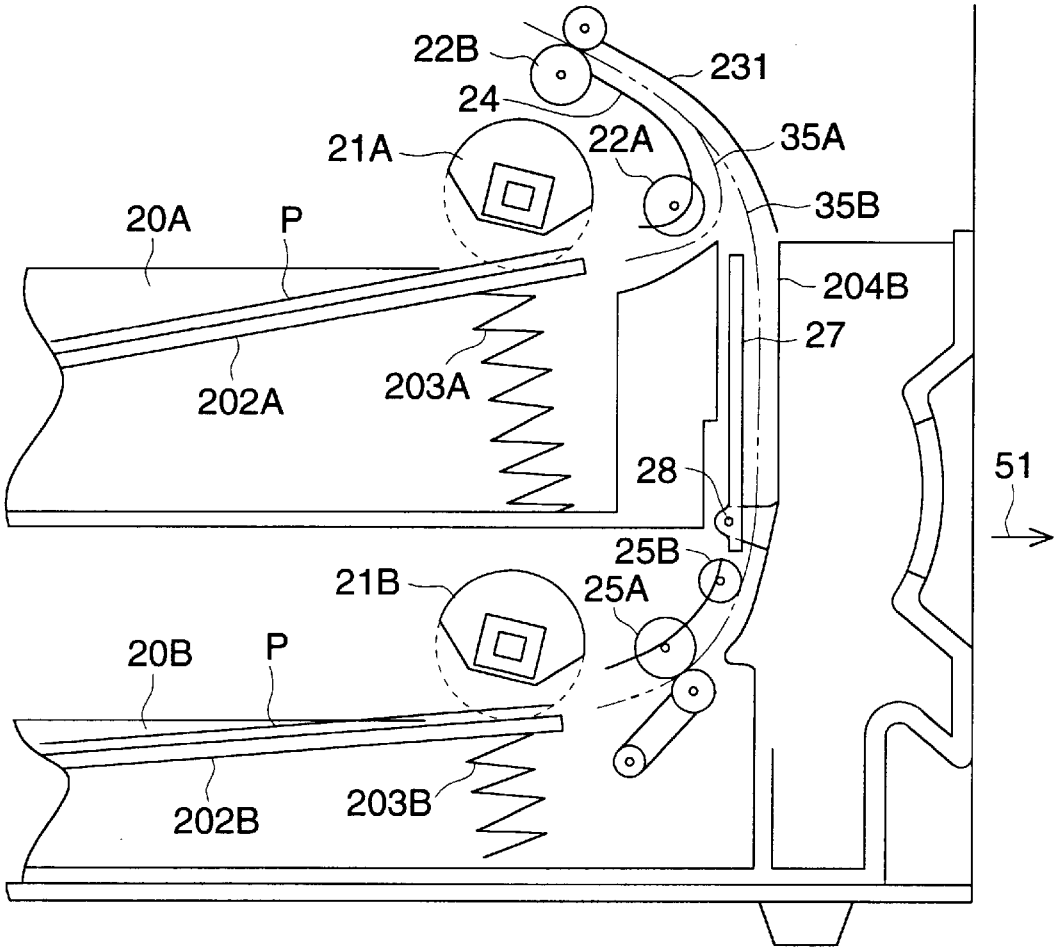
FIG. 2 is a side view showing a constitution of a paper feeding section in the first paper cassette and the second paper cassette.
Figure 3:
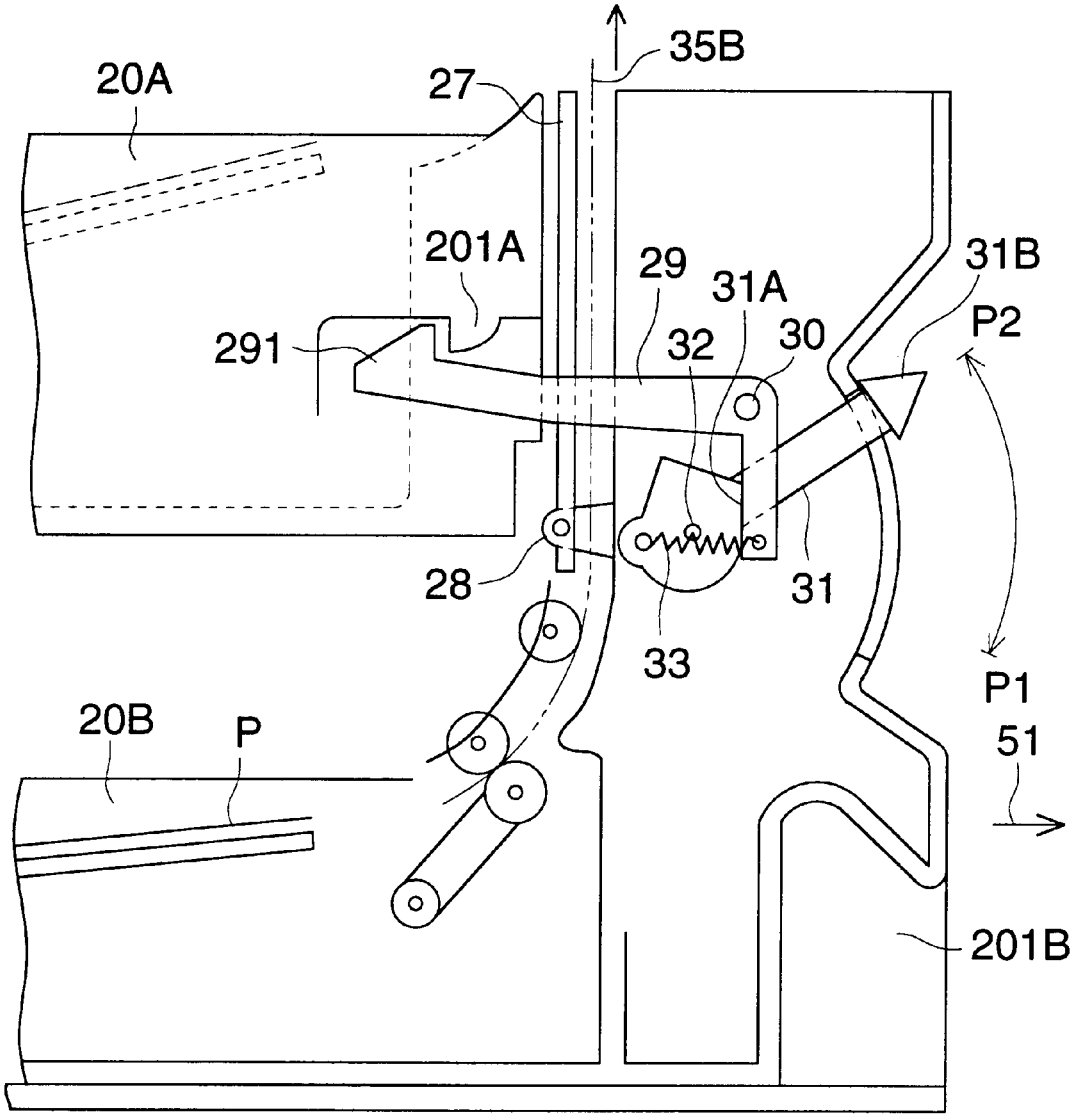
FIG. 3 is a side view showing a constitution of a main portion in the first paper cassette and the second paper cassette when they are engaged with the apparatus main body.
Figure 4:
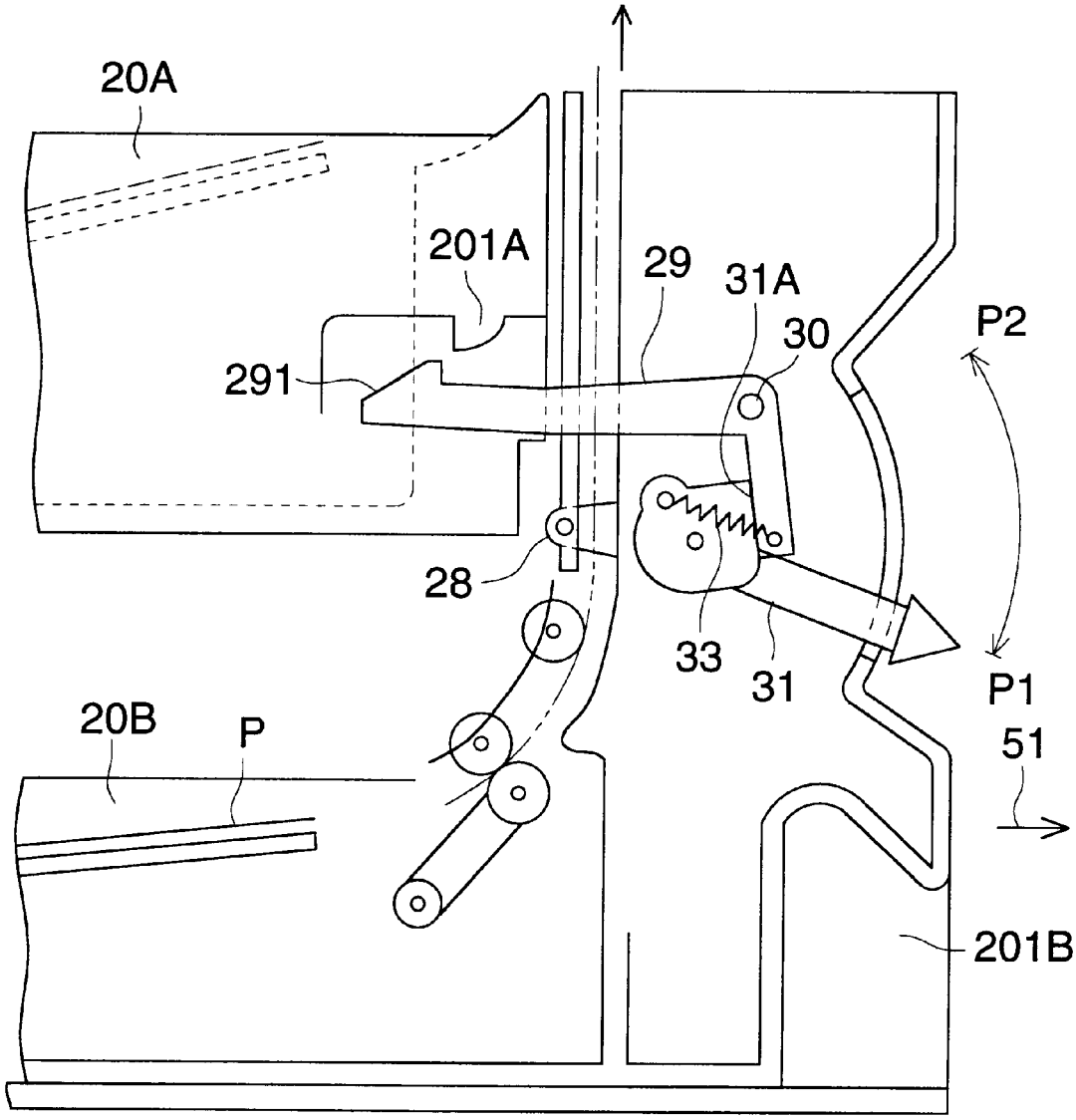
FIG. 4 is a side view showing a constitution of a main portion in the first paper cassette and the second paper cassette when they are disengaged with the apparatus main body.
Figure 5:
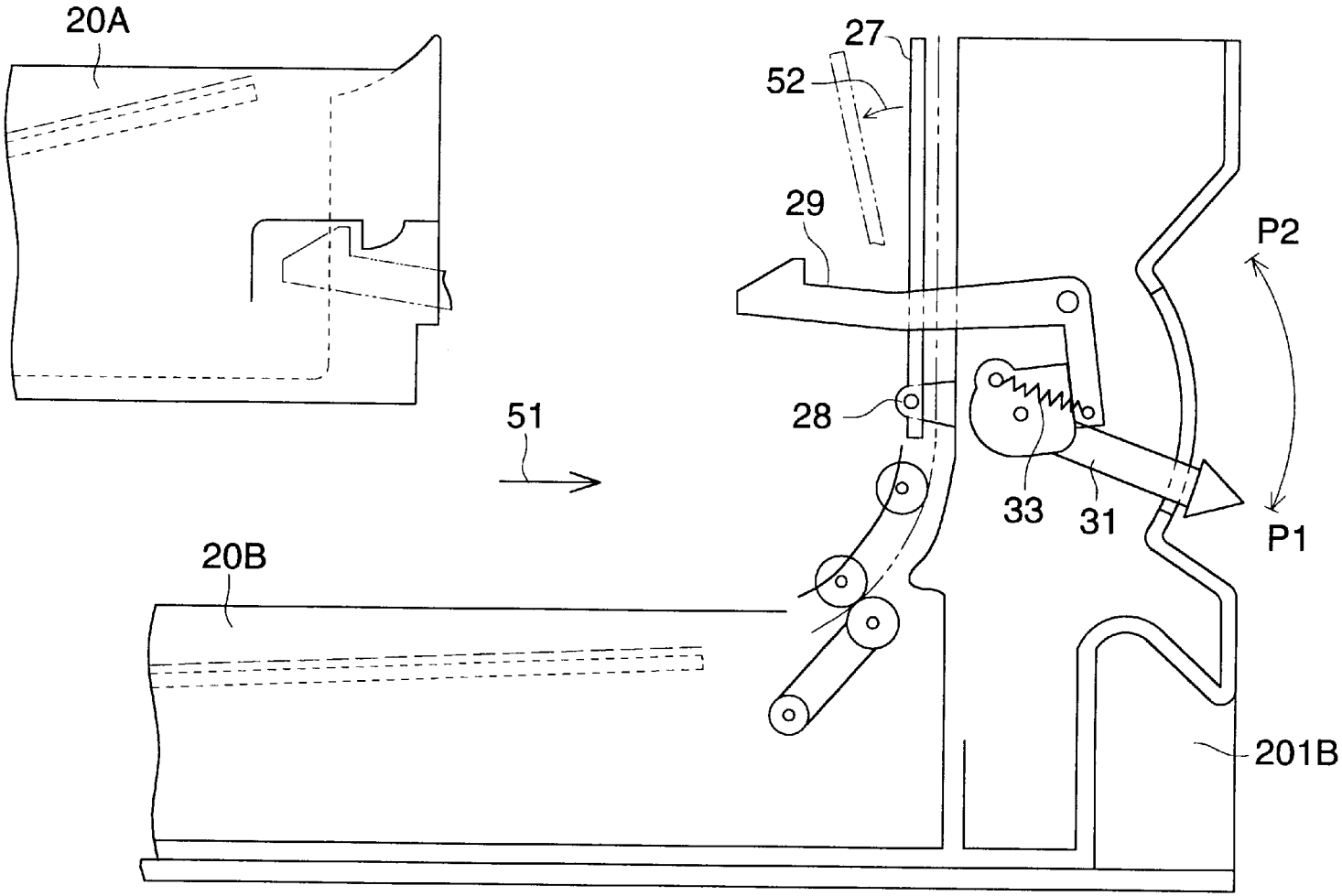
FIG. 5 is a side view showing a constitution of a main portion in the second paper cassette when it is disengaged with the apparatus main body.
Figure 6:
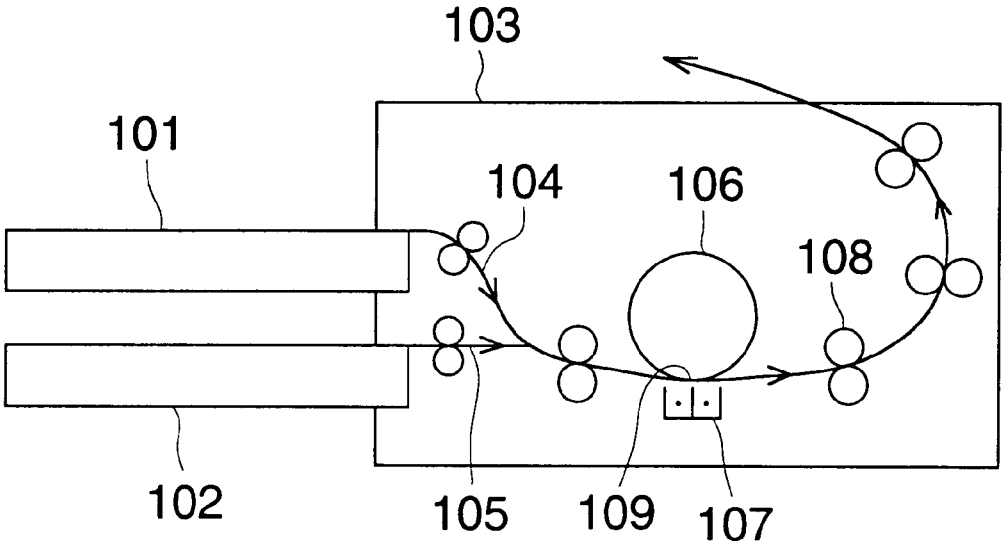
FIG. 6 PRIOR ART
FIG. 6 is a side view showing a constitution of a conventional image forming apparatus.

An image forming apparatus of a preferred embodiment will now be explained referring to drawings. FIG. 1 is a side view showing a constitution of the image forming apparatus of the preferred embodiment of the present invention. FIG. 2 is a side view showing a constitution of a paper feeding portion of the first and second paper cassettes. FIG. 3 is a side view showing the constitution of the main portion of the first and second paper cassettes when they are engaged. FIG. 4 is a side view showing the constitution of the main portion of the first and second paper cassettes when they are disengaged. FIG. 5 is a side view showing the constitution of the main portion of the second paper cassette when it is withdrawn from the main body of the apparatus.

Prior to explaining the preferred embodiment of the present invention, the constitution and the operations of a color printer, which is an example of an image forming apparatus in which plural paper cassettes are loaded therein, will be explained referring to FIG. 1.

In aforesaid color printer, after each color toner image successively formed on an image carrier is superposed, each color toner image is transferred onto aforesaid paper sheet simultaneously in the transfer section to form a color image. After that, a paper is separated from the image carrier surface by means of a separation means.

In FIG. 1, numeral 10 represents a photoreceptor drum, which is an electrically grounded image carrier, rotating clockwise as shown in FIG. 1. Numeral 11 represents a scorotron charger. On the circumference of photoreceptor drum 10, uniformly high potential charging is applied by means of corona charger using a grid whose potential is maintained at grid potential $V_G$ and by a corona charging wire. In order to remove all traces on the photoreceptor from the previous printing, exposure by means of a pre-charging lamp (PCL) is conducted to electrically neutralize the surface of the photoreceptor.

After uniform charging of photoreceptor drum 10, image exposure is conducted by means of image exposure means 13 based on image signals. Aforesaid image exposure means 13 employs a laser diode (not illustrated) as a light emission light source. Through a rotating polygonal mirror, an fθ lens and a cylindrical lens, the laser beam is curved in its path so that scanning is conducted. Due to rotation of photoreceptor drum 10, a latent image is formed.

On the circumference of photoreceptor drum 10, are developing device 14 composed of yellow (Y), magenta (M), cyan (C) and black (K) developing devices 14Y, 14M, 14C and 14K each of which houses two-component developer composed of toner and carrier.

First, development for the first color, yellow, is conducted by developer carrier 141 (hereinafter, referred to as development sleeve) which houses a magnet and which has a developer for rotating. The thickness of the developer is regulated to be the thickness of the developer layer on development sleeve 141 to be conveyed to the developing region.

After developing for the first color is finished, the image forming process for the second color, magenta, starts. Uniform re-charging by means of scorotron charger 11 is conducted again. A latent image by means of image data for the second color is formed by image exposure means 13. At this time, electrical neutralizing by means of PCL 12 conducted in the image forming process is not conducted since the toner adhered to the image section for the first color tends to scatter due to abrupt reduction of the surrounding potential.

In the photoreceptor in which the circumference of photoreceptor drum 10 was charged to photoreceptor charging potential V, on portions where there is no image for the first color, an image similar to the first color is formed for developing. If portions where there is an image for the first color are subjected to developing, a latent image having potential $V_M$ which is slightly higher than potential $V_L$ of the exposure section for the first color is formed due to influence of light-shielding and the inherent charge of the toner has by itself by means of toner adhered for the first color, and development in accordance with the potential difference between DC bias $V_{DC}$ and potential $V_M$ is conducted.

With regard to cyan (the third color) and black (the fourth color), an image forming process similar to that for the second color (magenta) is conducted. Thus, on the circumference of photoreceptor drum 10, a visual image having four superposed colors is formed.

A toner supplying device which precisely replenishes novel toner for each color to each of the above-mentioned developing devices 14Y, 14M, 14C and 14K is constituted of plural toner cartridges 15 (Y, M, C and K) detachable, toner storage means 16 (Y, M, C and K) and toner conveyance means 161 (Y, M, C and K).

One sheet of paper P fed from first paper cassette 20A by means of semicircular roller 21A, through intermediate paper feeding rollers 22A and 22B, temporarily stops in the vicinity of a registration sensor. When transfer timing is ready, paper P is fed to the transfer region due to the rotation of paired registration rollers 23. Similarly, one sheet of paper P fed from second paper cassette 20B by means of semicircular roller 21B is fed between intermediate paper feeding rollers 25A and 25B, intermediate paper feeding rollers 22A and 22B and also between guiding plates 231 and 24. Hereinafter, paper P is fed to the transfer region in the same manner as from first paper cassette 20A.

In the transfer region, transfer means 17 which impresses voltage for synchronously transferring toner images by physically contacting the circumference of photoreceptor drum 10. Aforesaid transfer means 17 sandwiches paper fed P so that a multi-colored image is simultaneously transferred.

Next, paper P is electrically neutralized by separation means 18, and is separated from the circumference of photoreceptor drum 10 to be conveyed to fixing device 40. After the toner is melted due to heating and pressed by means of heating roller (upper roller) 401 and pressure roller (lower roller) 402, paper P is fed to paper ejection tray 42 through paired paper ejection rollers 41A, 41B and 41C. Incidentally, after paper P has passed, transfer means 17 is retracted from the surface of photoreceptor drum 10, which is subsequently prepared for the next toner image formation cycle.

From photoreceptor drum 10 from which paper P was separated, any residual toner is removed by blade 191 of cleaning device 19, and thus photoreceptor drum 10 is cleaned for the subsequent cycle. After electrical neutralization by means of PCL 12 and re-charging by means of scorotron charger 11, the next image forming process commences. Immediately after the cleaning of the photoreceptor surface by blade 191, aforesaid blade 191 is retracted from the circumference of photoreceptor drum 10. Waste toner scraped into cleaning device 19 by blade 191 is moved by means of screw 192, and then stored in a toner collection container (not illustrated). Thus, one cycle of color copying is completed.

Next, the structure and the operations of the paper loading section located at the lower portion of the apparatus main body will be explained referring to FIGS. 2 through 5 with respect to the feeding of paper sheets and loading of the paper cassettes.

First, feeding of the paper sheets will be explained. FIG. 2 shows detachable first paper cassette 20A and detachable second paper cassette 20B at the lower portion of the apparatus main body, by which individual paper sheets are selectively fed to the apparatus main body from a specific paper cassette. In second paper cassette 20B, papers are housed on bottom plate 202B supported by spring 203B, and further a paper feeding section to accept aforesaid fed sheets is integrally provided at the front portion of the second paper cassette. Aforesaid paper feeding section is provided at a leading edge in the pulling out direction 51 of first paper cassette 20A. Namely, the paper feeding section is integrally provided on the second paper cassette 20B so that the paper feeding section is positioned in the front side (right side in FIG. 2) of the pulling out surface (the right end surface in FIG. 2) of the first paper cassette 20A. Incidentally, semicircular roller 21B is provided within the apparatus main body side. Paper P is fed out from second paper cassette 20B in the same direction as pulling out direction 51 of aforesaid cassettes. Paper P is fed through paper feeding path 35B bound for the apparatus main body. More specifically, paper P is fed from second paper cassette 20B by means of semicircular roller 21B provided on the apparatus main body side. Paper P is further fed by intermediate paper feeding rollers 25A and 25B. Paper P passes through a gap between guiding plate 27 and guiding wall 204B of second paper cassette 20B, and still further conveyed to intermediate paper feeding rollers 22A and 22B provided as part of the apparatus main body side.

First paper cassette 20A is provided above second paper cassette 20B. First paper cassette 20A houses paper P above bottom plate 202A forced up by spring 203A. Incidentally, the paper is fed from first paper cassette 20A along paper feeding path 35A in the same direction as the withdrawing direction 51 of first paper cassette 20A. More particularly, paper P is fed by means of semicircular roller 21A in the apparatus main body, and fed by the use of intermediate paper feeding rollers 22A and 22B housed in the apparatus main body.

Next, the withdrawing structure and the operations of the first paper cassette and the second paper cassette will be explained. In FIG. 3, when knob 31B of operation finger 31, which is a part of an engaging means located on second paper cassette 20B is lowered from position P2 to position P1, the operation finger rotates clockwise with shaft 32 as the center. Cam 31A which operates detaching lever 29 is rotated. Detaching lever 29, which is brought into contact with the cassette, rotates counterclockwise with shaft 30 as the center. Claw 291 of detaching lever 29 is disengaged as shown in FIG. 4 by means of engaging section 201A of first paper cassette 20A.

In FIG. 5, if second paper cassette 20B is withdrawn from the front direction (see the arrowed direction 51 in FIG. 5) by pulling drawing section 201B by hand, only second paper cassette 20B can be withdrawn so that the paper can be replenished. In addition, if the paper fed from second paper cassette 20B is jammed at the paper feeding section, jammed paper can easily be removed when second paper cassette 20B is withdrawn in the same manner as the paper replenishing operation, guiding plate 27, rotatable with shaft 28, which is a guiding member, forms paper feeding path 35B in the paper feeding section and paper feeding path 35B can be opened in the arrowed direction 52 by moving the guiding plate. Specifically, when the guiding plate 27 is constituted so that the guiding plate 27 moves by its own weight concurrently with the pulling out operation of the second paper cassette 20B to thereby open the paper feeding path 35B, the operability of clearing jammed paper is improved.

In FIG. 3, if second paper cassette 20B is withdrawn in the arrowed direction 51 by taking withdrawing section 201B by hand while, with regard to first paper cassette 20A, knob 31B is positioned at P2, first paper cassette 20A is integrally withdrawn with second paper cassette 20B, and paper can be replenished to the first paper cassette 20A.

In an embodiment shown in FIG. 3, detaching finger 29, which is a part of the engaging means, is provided on second paper cassette 20B side. However, it may alternatively also be provided on first paper cassette 20A. In FIG. 3, guiding plate 27 of the embodiment is rotated by the use of shaft 28. However, the present invention is not limited thereto. Other than the rotation type, the guiding plate could also be opened the paper feeding path by means of a sliding system.

The above-mentioned constitution provides the following effects. Owing to the present invention, since the second paper cassette is placed below the first paper cassette and the paper feeding section which feeds papers from the second paper cassette to the apparatus main body can be withdrawn integrally with the second paper cassette, the paper cassette is not necessary to occupy noticeable floor area outside the apparatus main body and jammed paper can be removed easily.

Owing to the present invention, a detaching means which allows for detachment of the first paper cassette and the second paper cassette is provided. When the second paper cassette is to be withdrawn, engagement by means of the detaching means is released and only the second paper cassette is withdrawn. When the first paper cassette is to be withdrawn, if it is withdrawn to the front side, papers can be set and paper jams can be removed. If the paper feeding section is set integrally with the second paper cassette, the first paper cassette is hidden by aforesaid paper feeding section. If it is intended that papers are to be replenished in the first paper cassette, the first paper cassette can easily be withdrawn in addition to the above-mentioned effects by engaging both the first paper cassette and the second paper cassette and withdrawing both simultaneously.

Owing to the present invention, paper jams can be removed easily since the guiding section which forms the paper feeding section in the paper feeding section can be moved appropriately and the above-mentioned paper feeding path is open.

Owing to the present invention, papers fed to the apparatus main body are ejected in the same direction as when withdrawing the second paper cassette. If jamming occurred while papers were fed to the apparatus main body from the second paper cassette, only by feeding the second paper cassette, the paper feeding section is integrally withdrawn, paper jams can be removed with a simple operation and operability thereby is improved.

What is claimed is:

1. An image forming apparatus comprising:

(a) a first paper cassette provided in a lower portion of a main body of the image forming apparatus for housing recording papers therein and for feeding the recording papers to the main body through a first paper feeding path, at least a part housing the recording papers of the first paper cassette being capable of being pulled out in a pulling out direction which is in a feeding direction of the recording papers from the first cassette;

(b) a second cassette provided below the first paper cassette for housing recording papers therein, at least a part housing the recording papers of the second paper cassette being capable of being pulled out in the same pulling out direction of the first paper cassette; and (c) a paper feeding section integrally provided on the second paper cassette and located on a front side of the first paper cassette in the pulling out direction of the first and second paper cassettes, for exclusively feeding the recording papers from the second paper cassette to the main body of the image forming apparatus through a second paper feeding path.

2. The image forming apparatus of claim 1, further comprising an engaging member provided on at least one of the first and second paper cassettes for engaging the first and second paper cassettes, and an operation knob connected to the engaging member and provided outside the image forming apparatus for causing the first and second paper cassettes to engage each other via the engaging member, wherein when the first and second paper cassettes are engaged with each other via the engaging member through operation of the operation knob, the first and second paper cassettes can be integrally pulled out from the main body of the image forming apparatus.

3. The image forming apparatus of claim 1, further comprising a guiding member for forming the second paper feeding path, wherein the guiding member is movable so that the second paper feeding path can be widely exposed.

4. The image forming apparatus of claim 1, wherein the recording papers fed to the main body of the image forming apparatus are ejected in the pulling out direction of the first and second paper cassettes.

5. An image forming apparatus comprising:

(a) a first paper cassette provided in a lower portion of a main body of the image forming apparatus for housing recording papers therein, at least a part housing the recording papers of the first paper cassette being capable of being pulled out of a side of the main body;

(b) a second cassette provided below the first paper cassette for housing recording papers therein, at least a part housing the recording papers of the second paper cassette being capable of being pulled out of said side of the main body;

(c) a paper feeding section integrally provided on the second paper cassette and located at a leading edge in a pulling out direction of the first paper cassette, for exclusively feeding the recording papers from the second paper cassette to the main body of the image forming apparatus; and (d) an engaging member provided on at least one of the first and second paper cassettes for engaging the first and second paper cassettes, and an operation knob connected to the engaging member and provided outside the image forming apparatus for causing the first and second paper cassettes to engage each other via the engaging member, wherein when the first and second paper cassettes are engaged with each other via the engaging member through operation of the operation knob, the first and second paper cassettes can be integrally pulled out from the main body of the image forming apparatus.

* * * * *